US005680165A

United States Patent [19]

Takizawa et al.

[11] Patent Number: 5,680,165

[45] Date of Patent: Oct. 21, 1997

[54] JET RECORDING METHOD

[75] Inventors: Yoshihisa Takizawa, Kawasaki; Katsuhiro Shirota, Inagi; Hisao Yaegashi, Kawasaki, all of Japan

[73] Assignee: Canon Kabushiki Kaisha, Tokyo, Japan

[21] Appl. No.: 467,897

[22] Filed: Jun. 6, 1995

Related U.S. Application Data

[63] Continuation of Ser. No. 964,847, Oct. 22, 1992, abandoned.

[30] Foreign Application Priority Data

| | | | |
|---|---|---|---|
| Oct. 25, 1991 | [JP] | Japan | 3-279856 |
| Oct. 25, 1991 | [JP] | Japan | 3-279860 |
| Oct. 25, 1991 | [JP] | Japan | 3-279869 |
| Oct. 25, 1991 | [JP] | Japan | 3-279872 |
| Oct. 25, 1991 | [JP] | Japan | 3-279876 |

[51] Int. Cl.[6] ..... B41J 2/165

[52] U.S. Cl. ..... 347/88; 347/30; 347/35

[58] Field of Search ..... 347/29, 30, 88, 347/35

[56] References Cited

U.S. PATENT DOCUMENTS

| | | | |
|---|---|---|---|
| 4,410,899 | 10/1983 | Haruta et al. | 346/140 R |
| 4,723,129 | 2/1988 | Endo et al. | 346/1.1 |
| 4,853,717 | 8/1989 | Harmon et al. | 347/30 |
| 5,006,170 | 4/1991 | Schwarz et al. | 106/20 |
| 5,182,572 | 1/1993 | Merrit et al. | 346/1.1 |
| 5,218,376 | 6/1993 | Asai | 346/1.1 |
| 5,270,730 | 12/1993 | Yaegashi et al. | 346/1.1 |

FOREIGN PATENT DOCUMENTS

| | | |
|---|---|---|
| 54-161935 | 12/1979 | Japan . |
| 55-54368 | 4/1980 | Japan . |
| 58-108271 | 6/1983 | Japan . |
| 61-83268 | 4/1986 | Japan . |
| 61-159470 | 7/1986 | Japan . |
| 61-185455 | 8/1986 | Japan . |
| 61-197246 | 9/1986 | Japan . |
| 61-249768 | 11/1986 | Japan . |
| 62-48774 | 3/1987 | Japan . |

*Primary Examiner*—Valerie Lund

*Attorney, Agent, or Firm*—Fitzpatrick, Cella, Harper & Scinto

[57] ABSTRACT

In a jet recording method, a normally solid recording material is placed in a heat-melted state in a path defined by a nozzle leading to an ejection outlet and, in a recording step, is imparted with a thermal energy corresponding to a recording signal to generate a bubble, thus ejecting a droplet of the recording material out of the ejection outlet. As an improvement, prior to the recording step, the recording material is sucked or pressurized to be ejected out of the ejection outlet and, in the recording step, the bubble is communicated with ambience. As a result, the recording is started or resumed without discharge failure even after a long time of non-use or standing state.

7 Claims, 15 Drawing Sheets

JET RECORDING METHOD

This application is a continuation of application Ser. No. 07/964,847 filed Oct. 22, 1992, now abandoned.

FIELD OF THE INVENTION AND RELATED ART

The present invention relates to a jet recording method wherein droplets of a recording material are discharged or ejected to a recording medium.

In the jet recording method, droplets of a recording material (ink) are ejected to be attached to a recording medium such as paper for accomplishing recording. In the method disclosed in U.S. Pat. Nos. 4,410,899, 4,723,129 and 4,723,129 assigned to the present assignee among the known jet recording methods, a bubble is generated in the ink by applying a heat energy to the ink, and an ink droplet is ejected through an ejection outlet (orifice), whereby a recording head provided with high-density multi-orifices can be easily realized to record a high-quality image having a high resolution at a high speed.

In addition to the above, known jet recording methods may include the following.

Japanese Laid-Open Patent Application (JP-A) 161935/1979 discloses a recording method as illustrated in FIG. 17, wherein a liquid ink 31 in a chamber is gasified by operation of a heater 30 energized through electrodes 35, and the resultant gas 32 is ejected together with an ink droplet 33 through an ejection outlet. It is said that the plugging of an orifice can be prevented due to ejection of the gas 32 through a nozzle.

JP-A 185455/1986 discloses a recording method as illustrated in FIGS. 18A–18C, wherein a liquid ink 44 filling a minute gap 43 between a plate member 41 having a pore 40 and a heat-generating head 42 is heated by the head 42 (FIGS. 18A and 18B), and an ink droplet 46 is ejected by the created bubble 45 through the pore 40 together with the gas constituting the bubble (FIG. 18C) to form an image on recording paper.

JP-A 249768/1986 discloses a recording method as illustrated in FIGS. 19A and 19B, wherein a liquid ink 50 is supplied with a heat energy by a heating member 51 to form a bubble, and an ink droplet 58 is ejected by expansion force of the bubble together with the gas constituting the bubble through a large aperture to the ambience.

JP-A 197246/1986 discloses a recording method as illustrated in FIG. 20, wherein ink 62 filling a plurality of bores 61 formed in a film 60 is heated by a recording head 64 having a heating element 63 to generate a bubble 67 in the ink 62, thus ejecting an ink droplet 65 onto a recording medium 66 (at (a)–(f) in order in FIG. 20).

Our research group has proposed a new jet recording method (hereinafter referred to as "bubble-through jet recording method"), wherein a recording material is supplied with a thermal energy corresponding to a recording signal to generate a bubble in the recording material so that a droplet of the recording material is discharged out of an ejection outlet under the action of the bubble, wherein the bubble is caused to communicate with the ambience. According to the bubble-through jet recording method, the splash or mist of the recording material is prevented. Further, according to bubble-through jet recording method, all the recording material between the created bubble and the ejection outlet is ejected, so that the discharged amount of the recording material droplet becomes constant depending on the shape of a nozzle and the position of a heater therein, whereby a stable recording becomes possible.

The inks used in the jet recording method are required to satisfy contradictory properties that they are quickly dried to be fixed on the recording medium but they do not readily plug a nozzle due to drying in the nozzle.

For complying with the requirements, the conventional normally liquid inks generally comprise water as a principal constituent and also contain a water-soluble high-boiling solvent, such as a glycol, for the purposes of preventing drying and plugging, etc. When such inks are used for recording on plain paper, there are encountered several problems such that the inks are not quickly dried to be fixed and the ink image immediately after the printing is liable to be attached to hands on touching and smeared to lower the printing quality.

Further, the ink penetrability remarkably varies depending on the kind of recording paper, so that only special paper is usable when such conventional aqueous inks are used. In recent years, however, it is required to perform good recording on so-called plain paper, inclusive of copy paper, report paper, note book paper and letter paper.

In order to solve the above problems, there have been disclosed jet recording methods wherein a normally solid hot melt-type ink is heat-melted to be emitted in U.S. Pat. No. 5,006,170, JP-A 108271/1983, JP-A 83268/1986, JP-A 159470/1986, JP-A 48774/1987 and JP-A 54368/1980.

When such a normally solid ink to be ejected under the action of a bubble is held in a standby state (not actually used for recording), the ink is liable to be highly viscous and result in discharge failure due to nozzle clogging in some cases.

SUMMARY OF THE INVENTION

An object of the present invention is to provide an improvement in the bubble-through jet recording method proposed by our research group.

A more specific object of the present invention is to provide a reliable jet recording method wherein a recording material having a high viscosity formed during a long term of non-working of an apparatus can be removed, thus obviating discharge failure or unstable discharge.

According to the present invention, there is provided a jet recording method, comprising:

a preliminary step of placing a normally solid recording material in a heat-melted state in a path defined by a nozzle leading to an ejection outlet, and a recording step of imparting the melted recording material a thermal energy corresponding to a recording signal to generate a bubble, thus ejecting a droplet of the recording material out of the ejection outlet under the action of the bubble;

wherein, prior to the recording step, the recording material is sucked or pressurized to be ejected out of the ejection outlet and, in the recording step, the bubble is communicated with ambience.

These and other objects, features and advantages of the present invention will become more apparent upon a consideration of the following description of the preferred embodiments of the present invention taken in conjunction with the accompanying drawings.

DETAILED DESCRIPTION OF THE INVENTION

In the recording method according to the present invention providing an improvement in the bubble-through jet recording method proposed by our research group, a normally solid recording material (ink, i.e., a recording material which is solid at room temperature (5° C.–35° C.)) is melted under heating, and the melted recording material is supplied with a heat energy corresponding to given recording data to be ejected through an ejection outlet (orifice) for recording.

First of all, the bubble-through jet recording method proposed by our research group is described hereinbelow with reference to the drawings.

In the bubble-through jet recording method, when the recording material in a melted state is imparted With a heat energy corresponding to a recording signal, a bubble is created in the recording material and the created bubble generates an ejection energy for ejecting the recording material through an ejection outlet.

Figure 1:
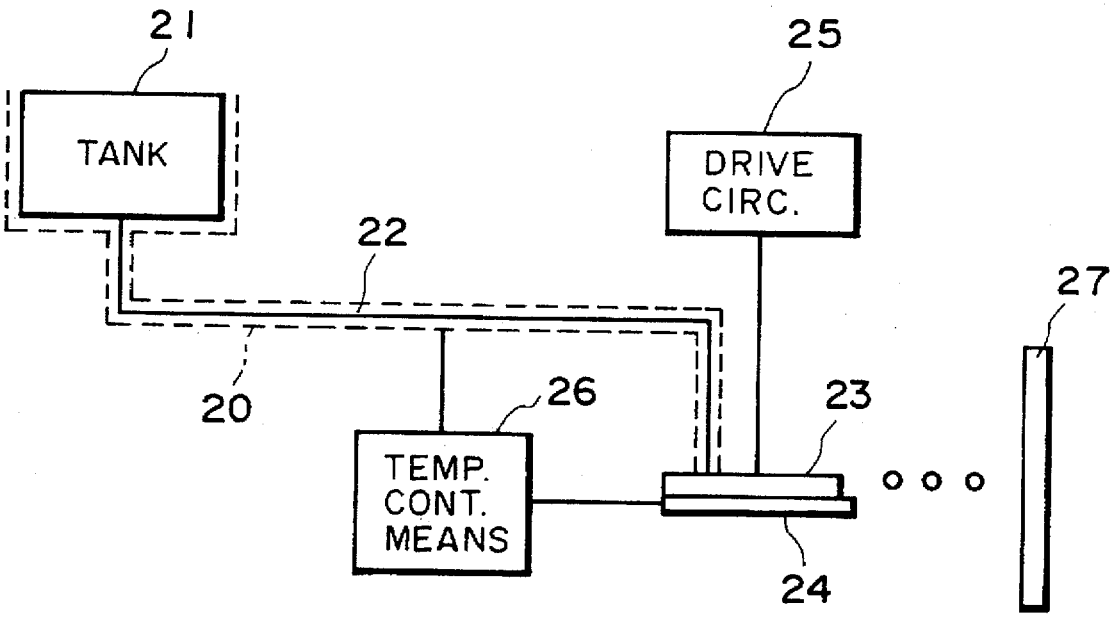
FIG. 1 is a schematic illustration of an embodiment of a recording apparatus for use in a recording method according to the invention.

FIG. 1 illustrates an apparatus for practicing the recording method according to the present invention, wherein a recording material contained in a tank 21 is supplied through a passage 22 to a recording head 23. The recording head 23 may for example be one illustrated in FIGS. 2A and 2B. The tank 21, passage 22 and recording head 23 are supplied with heat by heating means 20 and 24 to keep the recording material in a liquid state in the apparatus. The heating means 20 and 24 are set to a prescribed temperature, which may suitably be higher by 10°–50 ° C., preferably by 25°–35° C., than the melting point of the recording material, by a temperature control means 26. The recording head 23 is supplied with a recording signal from a drive circuit 25 to drive an ejection energy-generating means (e.g., a heater) in the recording head corresponding to the recording signal, whereby droplets of the recording material are discharged to effect recording on a recording medium 27, such as paper.

Figure 2A:
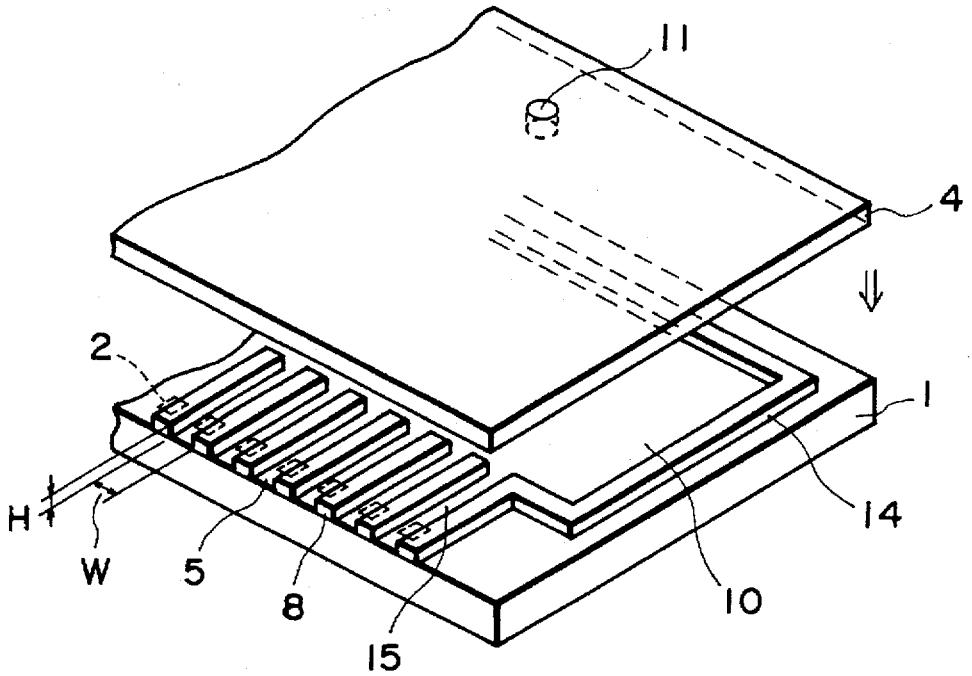
FIGS. 2A and 2B are a schematic partial perspective view and a schematic plan view of a recording head used in the recording apparatus shown in FIG. 1.
Figure 2B:
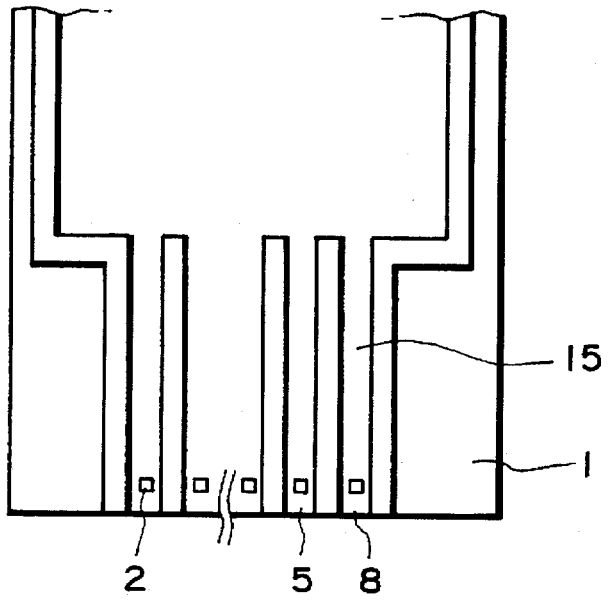

As shown in FIGS. 2A and 2B, the head 23 is provided with a plurality of walls 8 disposed in parallel with each other on a substrate 1 and a wall 14 defining a liquid chamber 10. On the walls 8 and 14, a ceiling plate 4 is disposed. In FIG. 2A, the ceiling plate 4 is shown apart from the walls 8 and 14 for convenience of showing an inside structure of the recording head. The ceiling plate 4 is equipped with an ink supply port 11, through which a melted recording material is supplied into the liquid chamber 10. Between each pair of adjacent walls 8, a nozzle 15 is formed for passing the melted recording material. At an intermediate part of each nozzle 15 on the substrate 1, a heater 2 is disposed for supplying a thermal energy corresponding to a recording signal to the recording material. A bubble is created in the recording material by the thermal energy from the heater 2 to eject the recording material through the ejection outlet 5 of the nozzle 15.

In the bubble-through jet recording method, when a bubble is created and expanded by the supply of thermal energy to reach a prescribed volume, the bubble thrusts out of the ejection outlet 5 to communicate with the ambience (atmosphere). This point is explained further hereinbelow.

Figure 3A:
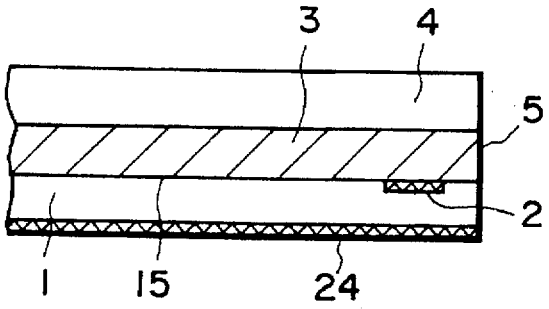
FIGS. 3A–3D are schematic sectional views of a recording head supplying a recording material for illustration of a principle of the recording method according to the invention.
Figure 3B:
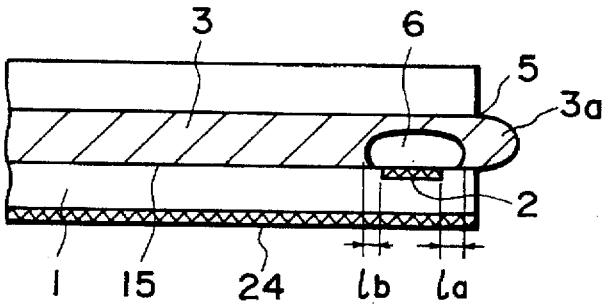
Figure 3C:
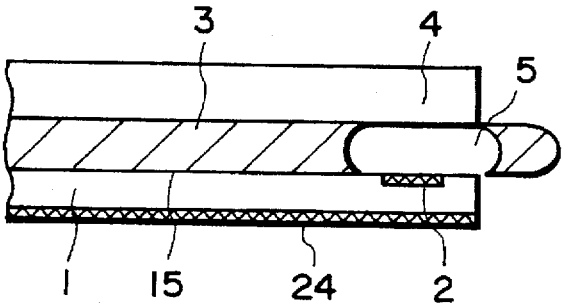
Figure 3D:
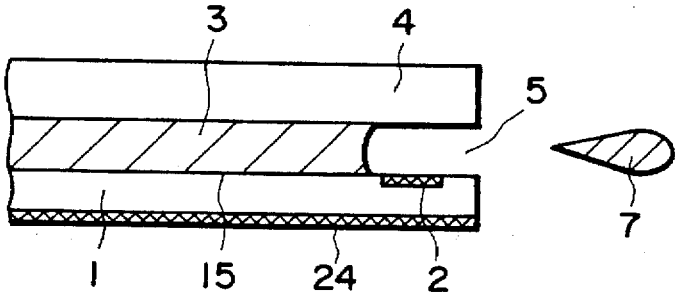

FIGS. 3A–3D show sections of a nozzle 15 formed in the recording head 23, including FIG. 3A showing a state before bubble creation. First, current is supplied to a heating means 24 to keep a normally solid recording material 3 melting. Then, the heater 2 is supplied with a pulse current to instantaneously heat the recording material 3 in the vicinity of the heater 2, whereby the recording material 3 causes abrupt boiling to vigorously generate a bubble 6, which further begins to expand (FIG. 3B). The bubble further continually expands and grows particularly toward the ejection outlet 5 providing a smaller inertance until it thrusts out of the ejection outlet 5 to communicate with the ambience (FIG. 3C). A portion of the recording material 3 which has been closer to the ambience than the bubble 6 is ejected forward due to kinetic momentum which has been imparted thereto by the bubble 6 up to the moment and soon forms a droplet to be deposited onto a recording medium, such as paper (not shown) (FIG. 3D). A cavity left at the tip of the nozzle 15 after the ejection of the recording material 3 is filled with a fresh portion of the recording material owing to the surface tension of the succeeding portion of the recording material and the wetness of the nozzle wall to restore the state before the ejection.

In the recording head 23, the heater 2 is disposed closer to the ejection outlet 5 than in the conventional recording head. This is the simplest structure adoptable for communication of a bubble with the ambience. The communication of a bubble with the ambience is further accomplished by desirably selecting factors, such as the thermal energy generated by the heater 2, the ink properties and various sizes of the recording head (distance between the ejection outlet and the heater 2, the widths and heights of the outlet 5 and the nozzle 15). The required closeness of the heater 2 to the ejection outlet 5 cannot be simply determined but, as a measure, the distance from the front end of the heater 2 to the ejection outlet (or from the surface of the heater 2 to the ejection outlet 5 in the cases of a recording head as shown in FIGS. 9A–9D) may preferably be 5–80 microns, further preferably 10–60 microns.

In order to ensure the communication of a bubble with the ambience, the nozzle 15 may preferably have a height H which is equal to or smaller than a width W thereof, respectively at the part provided with the heater 2 (FIG. 2A). In order to ensure the bubble communication with the ambience, the heater 2 may preferably have a height H which is 50–95%, particularly 70–90%, of the width W of the nozzle. Further, it is preferred that the recording material is melted under heating by the heating means 24 to have a viscosity of at most 100 cps.

It is further preferred to design so that a bubble communicates with the ambience when the bubble reaches 70% or more, further preferably 80% or more, of a maximum volume which would be reached when the bubble does not communicate with the ambience.

Because the bubble created in the recording material communicates with the ambience in the bubble-through jet recording method, substantially all the portion of the recording material present between the bubble and the ejection outlet is ejected, so that the volume of an ejected droplet becomes always constant. In the conventional jet recording method, a bubble created in the recording material does not ordinarily communicate with the ambience but shrinks to disappear after reaching its maximum volume. In the conventional case where a bubble created in the recording material does not communicate with the ambience, not all but only a part of the portion of recording material present between the bubble and the ejection outlet is ejected.

In the jet recording method wherein a bubble does not communicate with the ambience but shrinks after reaching the maximum, the bubble does not completely disappear by shrinkage but remains on the heater in some cases. If a small bubble remains on the heater, there arises a problem that bubble creation and growth for ejecting a subsequent droplet are not normally accomplished due to the presence of such a small bubble remaining on the heater. In contrast thereto, in the bubble-through jet recording method wherein a bubble is communicated with the ambience, all the recording material present between the bubble and the ejection outlet is ejected so that such a small bubble is not allowed to remain on the heater.

In the bubble-through jet recording method, only a small inertance is present between the heater 2 and the ejection outlet 5 of the recording head 23, so that the kinetic momentum of a created bubble 6 is effectively imparted to a droplet 7. For this reason, even a material having a high viscosity which cannot be easily ejected according to the conventional recording method, such as a liquefied ink formed by heating a normally solid recording material to above its melting point, can be stably ejected. Further, in the bubble-through jet recording method, the ejection speed of the recording material becomes very fast because a bubble created in the recording material communicates with the ambience. Accordingly, a droplet of the recording material is attached accurately to an objective point on the recording medium, and even a normally solid recording material can be attached to the recording medium in a small thickness without pile-up. The attachment in a small thickness of the solid recording material on the recording medium is most advantageous in superposing several colors of recording materials on a single recording medium to form a multicolor image.

In the bubble-through jet recording method, it is preferred that a bubble created by the heater 2 is caused to communicate with the .ambience out of the ejection outlet 5 when the internal pressure of the bubble is not higher than the ambient (atmospheric) pressure.

Figure 4:
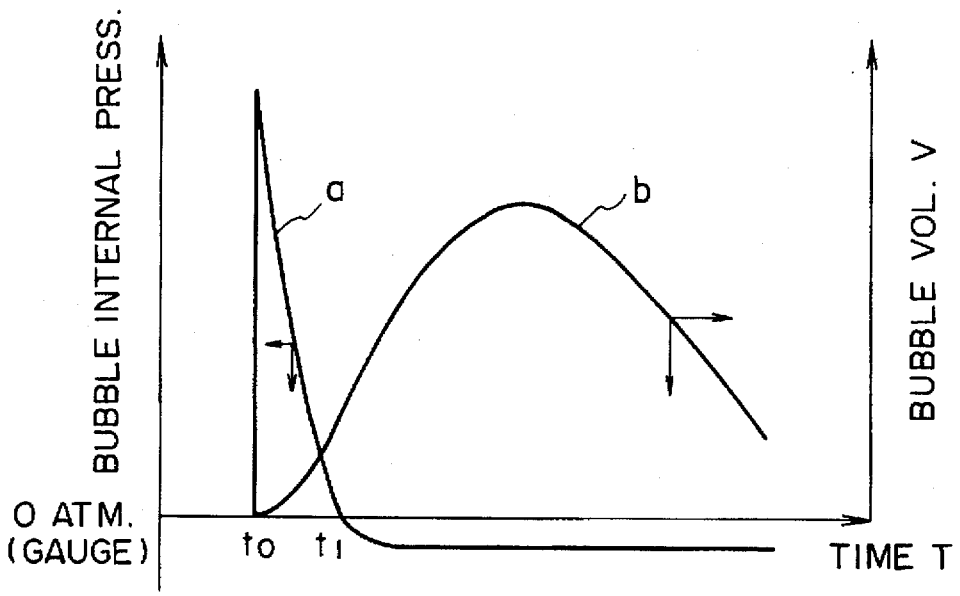
FIG. 4 is a graph showing an example of changes in internal pressure and volume of a bubble in the case of non-communication of the bubble with the ambience (atmosphere).

FIG. 4 is a graph showing a relationship between the internal pressure (curve a) and the volume (curve b), of a bubble in case where the bubble does not communicate with the ambience. Referring to FIG. 4, at time $T=t_0$ when the heater 2 is energized with a pulse current, a bubble is created in the recording material to cause an abrupt increase in bubble internal pressure and the bubble starts to expand simultaneously with the creation.

The bubble expansion does not cease immediately after the termination of current supply to the heater 2 but continues for a while thereafter. As a result, the bubble internal pressure abruptly decreases to reach a pressure below the ambient pressure (0 atm.-gauge) after $T=t_1$. After expansion to some extent, the bubble starts to shrink and disappears.

Figure 5:
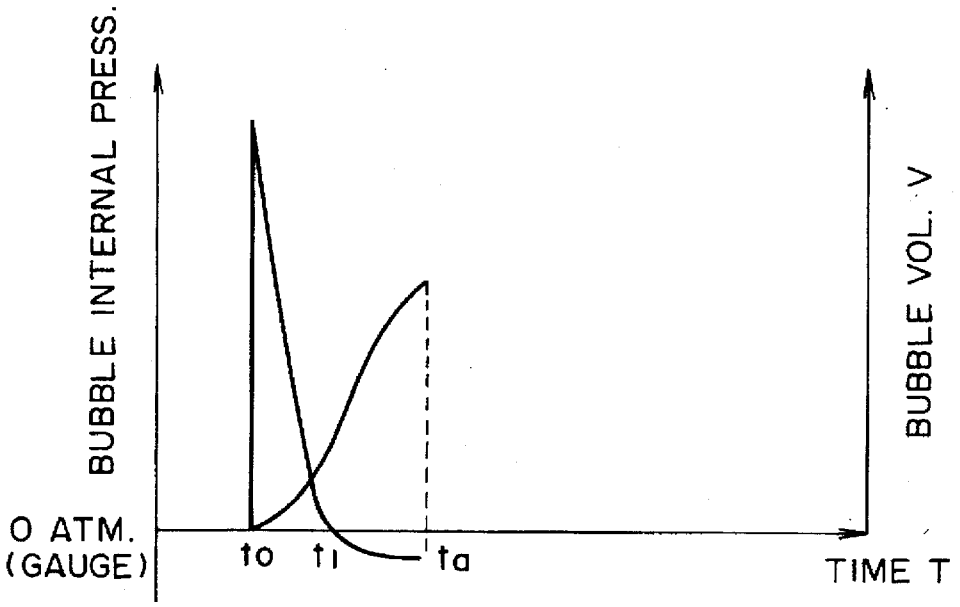
FIG. 5 is a graph showing an example of changes in internal pressure and volume of a bubble in the case of communication of the bubble with the ambience.

Accordingly, if the bubble is caused to communicate with the ambience at some time after time $T=t_1$, e.g., time $t_a$, as shown in FIG. 5, the bubble internal pressure immediately before the communication is lower than the ambient pressure.

If the bubble is communicated with the ambience to eject a droplet when the internal pressure thereof is below the ambient pressure, the formation of splash or mist of the recording material unnecessary for recording can be prevented, so that the soiling of the recording medium or the apparatus is avoided.

Hitherto, in the conventional jet recording method, there has been encountered a problem that splash or mist of the recording material is ejected in addition to a droplet effective for recording. The occurrence of such splash or mist can be prevented by lowering the bubble internal pressure to a value not higher than the ambient pressure when the bubble is communicated with the ambience in the bubble-through jet recording method.

It is difficult to directly measure the bubble internal pressure, but the satisfaction of the condition of the bubble internal pressure being smaller than the ambient pressure may be suitably judged in the following manner.

Figure 6:
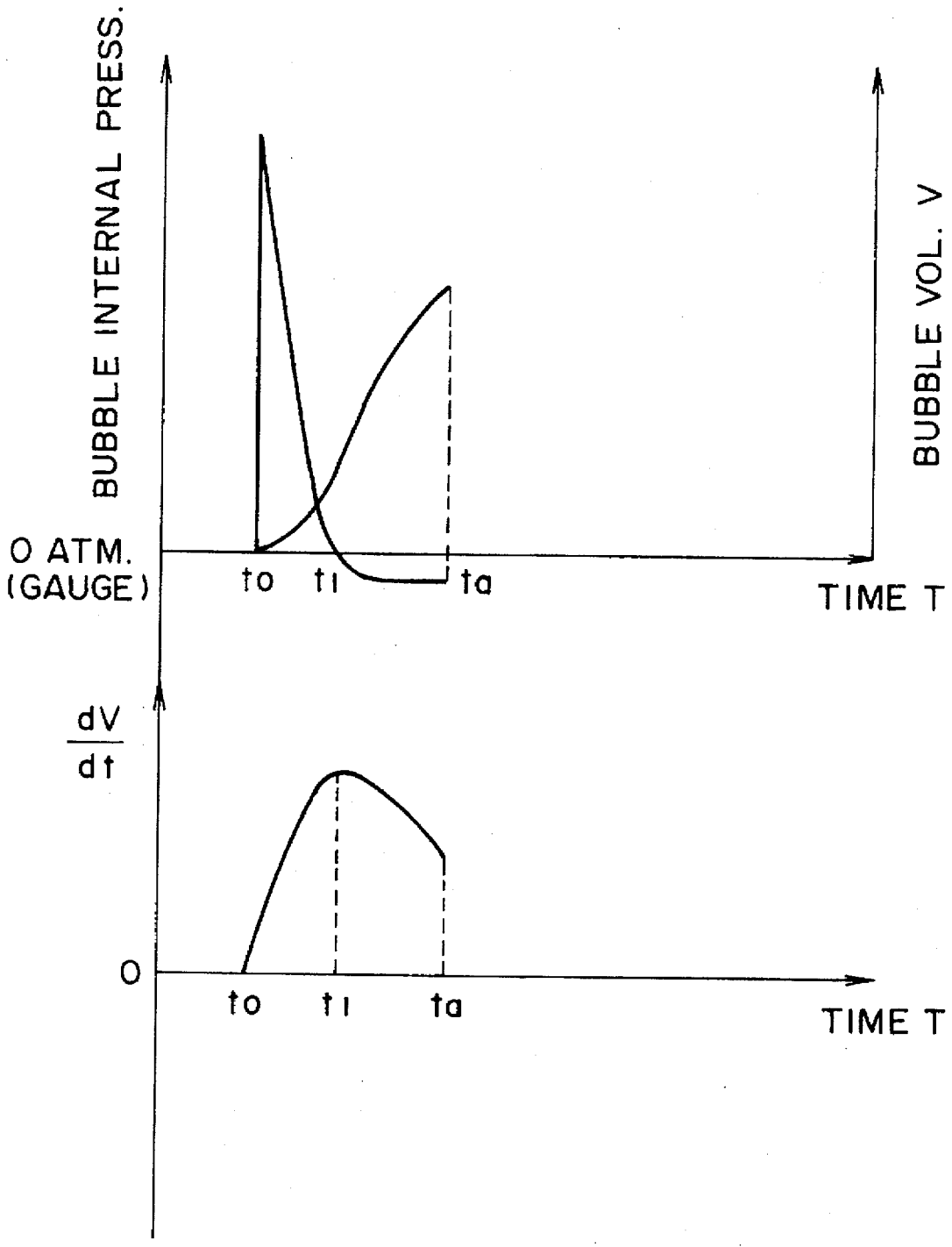
FIG. 6 is a graph showing an example of changes in internal pressure, volume and further volume-changing rate of a bubble in the case of communication of the bubble with the ambience.

The volume Vb of the bubble is measured from the start of the bubble creation to the communication thereof with the ambience. Then, the second order differential $d^2Vb/dt^2$ is calculated, based on which the relative magnitudes of the internal pressure and the atmospheric pressure may be judged. If $d^2Vb/dt^2>0$, the internal pressure is higher than the ambient pressure. If $d^2Vb/dt^2 \leqq 0$, the internal pressure is not higher than the ambient pressure. Referring to FIG. 6, during a period of from the state of bubble creation at time $T=t_0$ to time $T=t_1$, the bubble internal pressure is higher than the ambient pressure ($d^2Vb/dt^2>0$), and during a period from time $T=t_1$ to the bubble communication with the ambience at time $T=t_a$, the bubble internal pressure is lower than the ambient pressure. As described above, by calculating $d^2Vb/dt^2$, i.e., the second order differential of Vb, it is possible to know the relationship regarding magnitude between the bubble internal pressure and the ambient pressure.

Instead of measuring the above-mentioned bubble volume Vb, it is also possible to judge the relative magnitudes of the bubble internal pressure and the ambient pressure by measuring the volume Vd of a protrusion 3a (FIG. 3B) of the recording material out of the ejection outlet 5 (hereinafter called "ink protrusion 3a") in a period from the start of the bubble creation to the ejection of a droplet of the recording material (a period between the states shown in FIGS. 3a and 3C) and calculating the second order differential of Vd, i.e., $d^2Vd/dt^2$. More specifically, if $d^2Vd/dt^2>0$, the bubble internal pressure is higher than the ambient pressure, and if $d^2Vd/dt^2 \leqq 0$, the bubble internal pressure is not higher than the ambient pressure.

Figure 7:
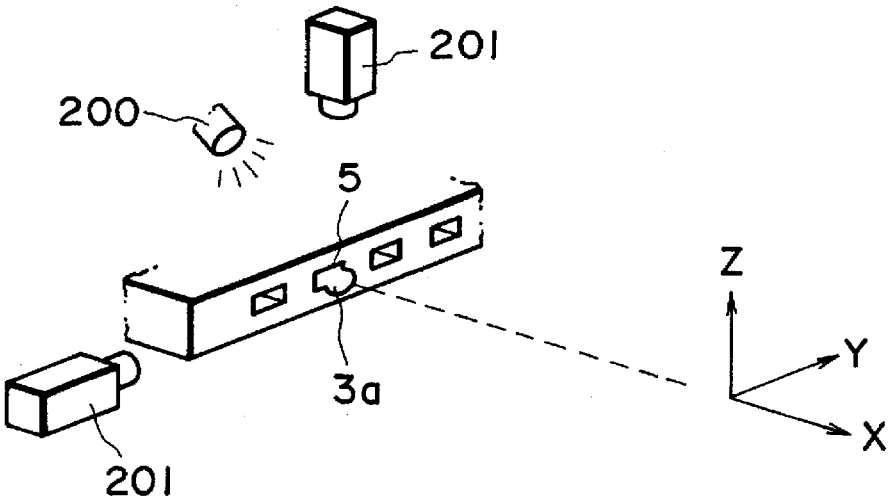
FIG. 7 is a perspective illustration of an example of a system for measuring the volume of a recording method droplet protruded from an ejection outlet.

The volume Vd of the ink protrusion 3a at various points of time may be measured by observation through a microscope of the ink protrusion 3a while it is illuminated with pulse light from a light source such as a stroboscope, LED or laser. The pulse light is emitted to the recording head driven at regular intervals for continuously ejecting droplets with synchronization with drive pulses for the recording head and with a predetermined delay, whereby the projective configuration of the ink protrusion 3a as seen in one direction at prescribed points of time. The pulse width of the pulse light is preferably as small as possible, provided that the quantity of the light is sufficient for the observation, so as to allow an accurate determination of the configuration. It is possible to roughly calculate the volume of the ink protrusion 3a by measurement in only one direction. For a more accurate determination, however, it is preferred to measure the configurations of the ink protrusion 3a simultaneously in two directions y and z which are perpendicular to each other and are respectively perpendicular to direction x in which droplets are ejected, as shown in FIG. 7. It is desirable that either one of the directions y and z for observation by microscopes 201 is disposed parallel to the direction of arrangement of the ejection outlets 5.

Figure 8:
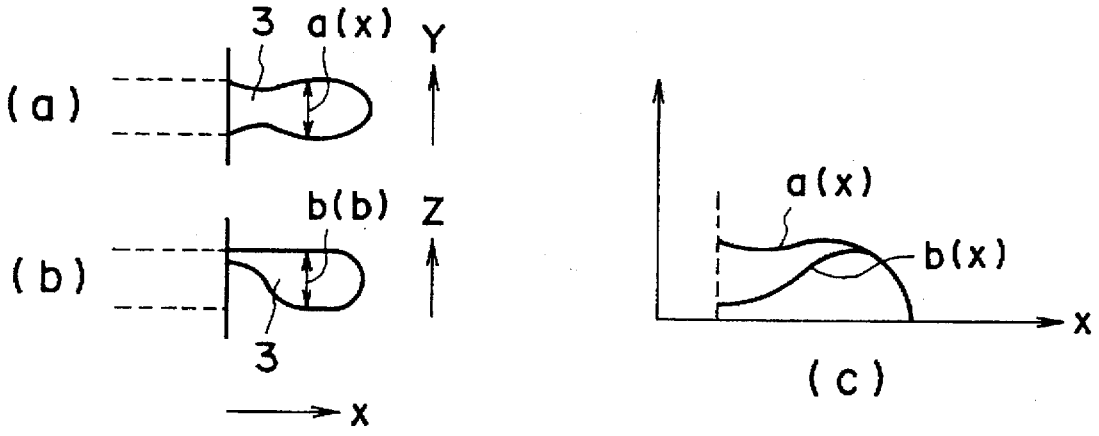
FIG. 8 shows a top plan view (*a*) and a side view (*b*) of a droplet, and a graph (*c*) showing the results given by the measurement using the system shown in FIG. 7.

Referring to FIG. 8, based on the observed images in the two directions y and z as shown at (a) and (b), the widths a(x) and b(x) along the x-axis of the ink protrusion 3a are measured. Using the measured widths a(x) and b(x) as functions of x as shown at (c), the volume Vd of the ink projection at a predetermined delay period can be calculated from the following equation:

$$Vd=(\pi/4)\int a(x).b(x)dx.$$

The above equation is based on approximation of the y-x cross-section of the ink projection 3a as an oval shape and is usable for calculation of volume of the ink projection 3a or bubble 6 at a sufficiently high accuracy.

Further, by gradually changing the delay period of the pulse light from the light source 200 from zero for a plurality of ink projections, the change in volume Vd with time of an ink projection from the creation of a bubble to the ejection of a corresponding droplet can be approximately obtained.

The volume Vb of a bubble in the nozzle 15 can be also measured by application of the method illustrated in FIG. 7. In this case for measurement of the bubble volume Vb, however, it is necessary to form a part of the recording head with a transparent member so that the bubble can be observed from outside the recording head.

In order to determine the behavior of the ink projection 3a and the bubble, a time resolution power of about 0.1 micro-sec is required, so that the pulse light source may preferably comprise an infrared LED and have a pulse width of about 50 n.sec., and the microscope 201 may preferably be connected to an infrared camera so as to photograph the image.

Further, if the bubble is communicated with the ambience when the first order differential of the moving speed of the bubble front in the ejection direction is negative, the occurrence of mist or splash can be further prevented.

Referring to FIG. 3B, if the distance $l_a$ from the ejection outlet 5 side end of the heater 2 as the ejection energy generating means to the front end (ejection outlet 5 side end) of a bubble 6 and the distance $l_b$ from the opposite side end of the heater 2 to the rear end (on the side opposite to the ejection outlet 5) of the bubble are set to satisfy $l_a/l_b \geqq 1$, preferably $l_a/l_b \geqq 2$, more preferably $l_a/l_b \geqq 4$, at an instant immediately before the communication with the ambience, it is possible to shorten the time for filling the cavity formed after ejection of the recording head with a fresh portion of the recording material, thus realizing a further high-speed recording. The ratio $l_a/l_b$ may be increased, e.g., by shortening the distance between the heater 2 and the ejection outlet 5.

Figure 9A:
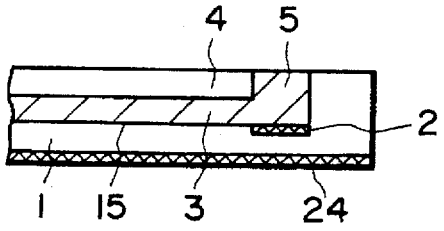
FIGS. 9A–9D are schematic sectional views of another example of a recording head supplying a recording material for illustration of a principle of the recording method according to the invention.
Figure 9B:
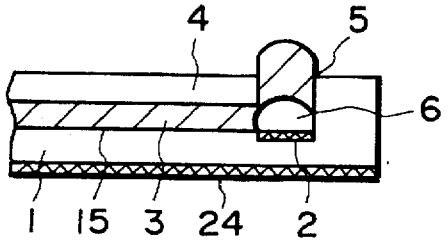
Figure 9C:
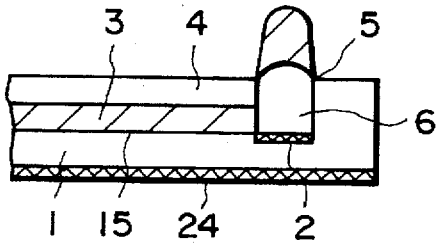
Figure 9D:
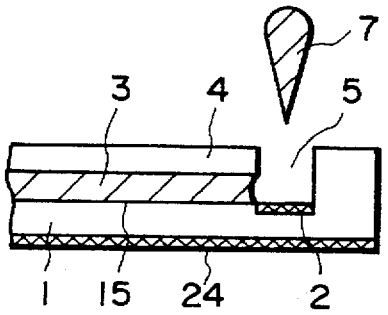

FIGS. 9A–9D illustrate another embodiment of the recording head used in the present invention which includes an ejection outlet 5 disposed on a lateral side of a nozzle 15. Also in the case of using the recording head shown in FIGS. 9A–9D, a bubble 6 is caused to communicate with the ambience similarly as in the case of using the head shown in FIGS. 3A–3D. More specifically, from a state of before bubble generation in FIG. 9A, a recording material 3 melted under operation of a heating means 24 is heated by energizing a heater 2 to create a bubble 6 on the heater 2 (FIG. 9B). The bubble 6 continues to expand (FIG. 9C) until it communicates with the ambience to eject a droplet 7 out of the ejection outlet 5 (FIG. 9D).

According to the present invention, in the bubble-through jet recording method described above, prior to the recording, a portion of the recording material having an elevated viscosity in the nozzles is removed by suction or pressurization.

Figure 10:
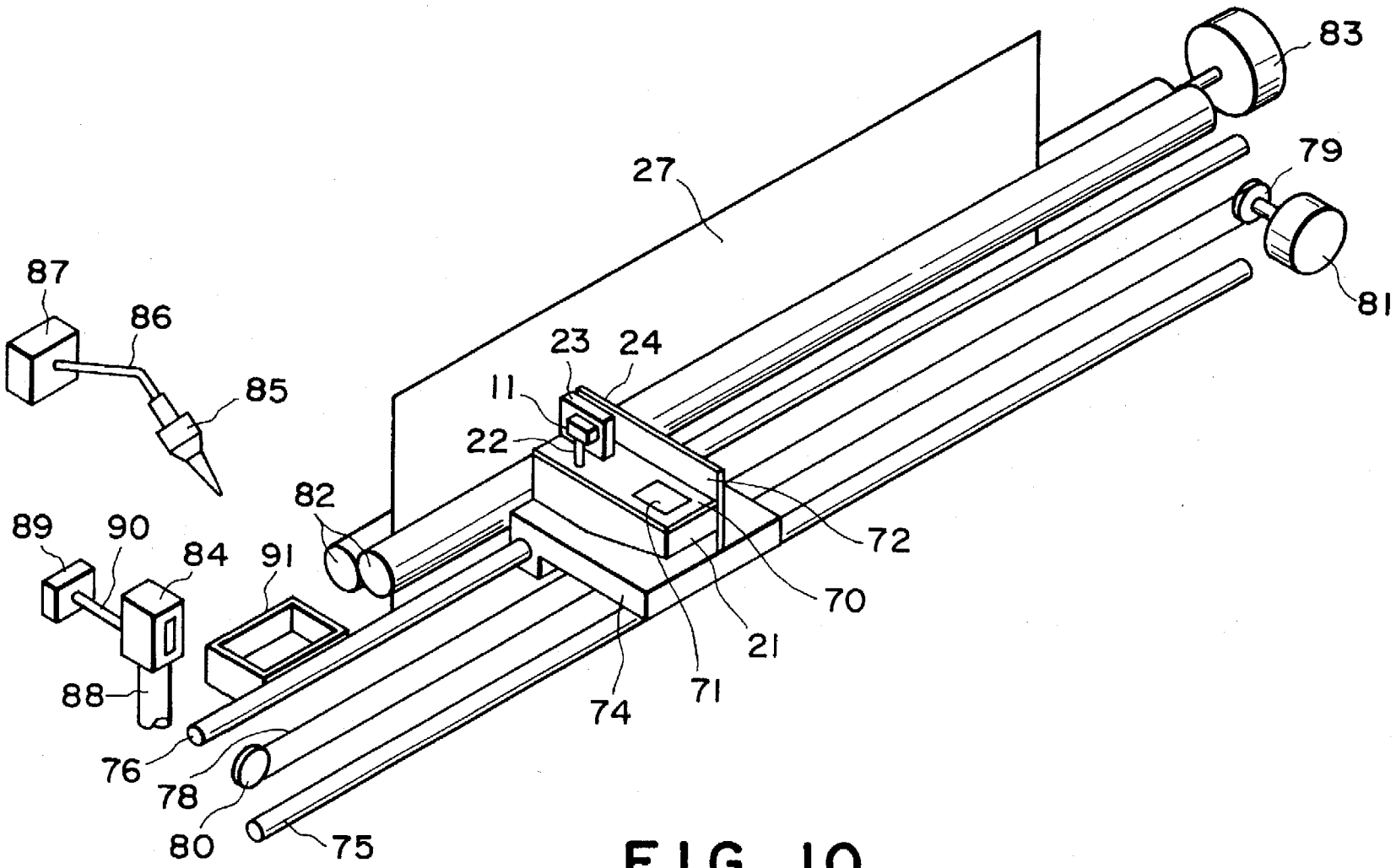
FIG. 10 is a perspective view showing an embodiment of a recording apparatus for use in the recording method according to the invention.
Figure 11A:
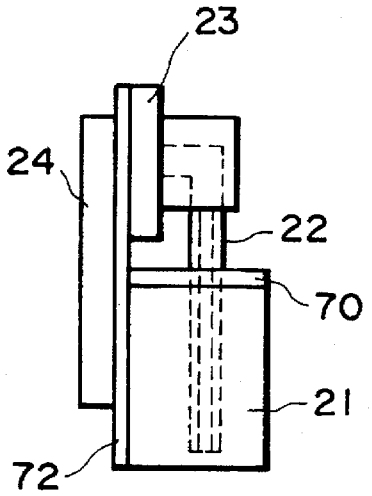
FIGS. 11A and 11B are a front View and a side view, respectively, of a device unit including embodiments of a recording head, a tank and a heating means.
Figure 11B:
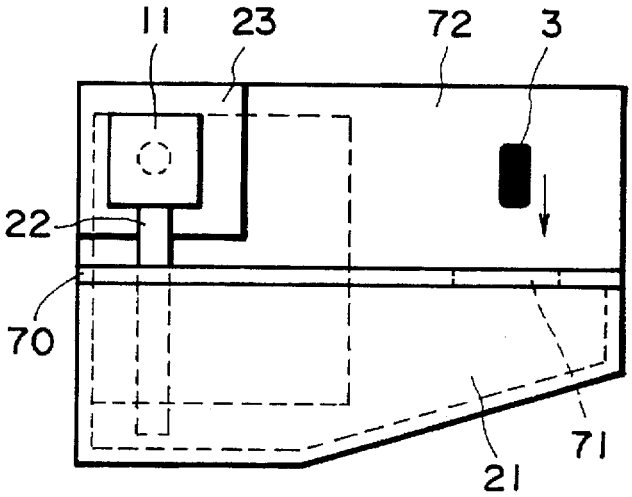

FIG. 10 illustrates details of a partial apparatus arrangement including the ink tank 21, the recording head 23, the heating means and the recording medium 27 shown in FIG. 1. FIGS. 11A and 11B are a front view and a side view, respectively, of a device unit including the ink tank 21, the recording head 23 and the heating means 24.

The recording head 23 is bonded to an aluminum base 72 affixed to a carriage 74. An aluminum-made ink supply pipe 22 is inserted vertically into the ink tank 21, and the upper end thereof is connected to the ink supply port 11 (FIG. 2A) of the recording head 23. The recording material 3 is supplied from the ink tank 21, via the ink supply pipe 22, to reach the ink supply port 11 and is supplied into the recording head 23. The ink tank 21 is covered with a tank lid 70 having an ink charge port 71 through which the recording material 3 is replenished from an ink replenishing means (not shown). The heating means 24 is disposed on the back side of the aluminum base 72 to keep the recording material 3 in a liquid state in the ink tank 21 and the recording head 23. The carriage 74 is moved along guides 75 and 76 in parallel with recording paper 27. The carriage 74 is fastened with a wire 78 under tension between a motor pulley 79 and a tension pulley 80. The carriage 74 is driven by a carriage motor 81 via the wire 78, The recording paper 27 is sandwiched between and fed by a pair of rollers 82. The rollers 82 are driven by a paper feed motor 83.

Figure 12:
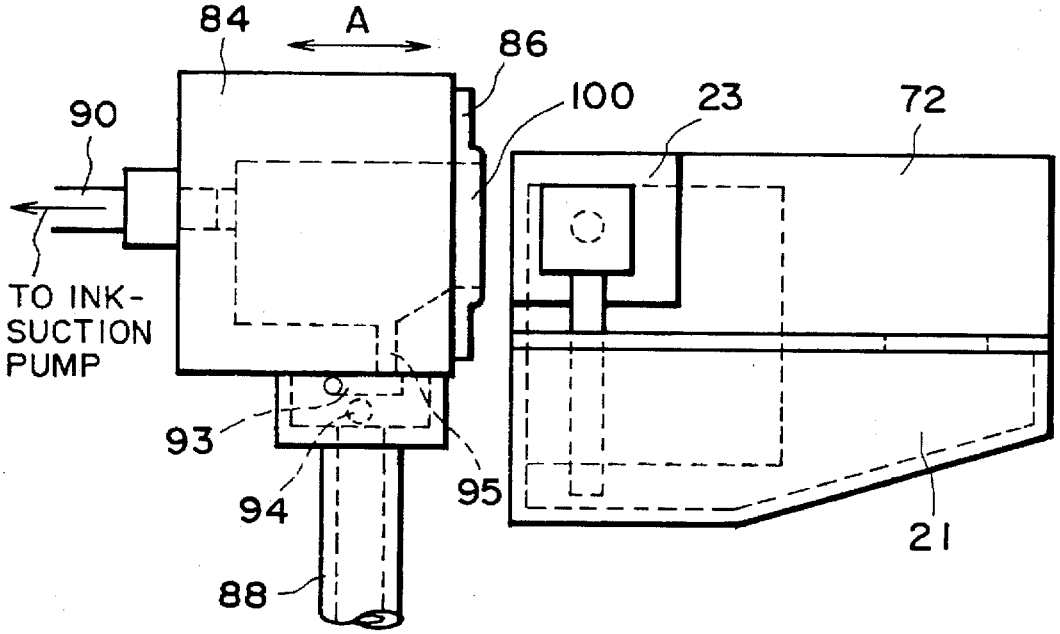
FIG. 12 is a side view for illustrating a relationship between an ink suction box and a recording head.
Figure 13:
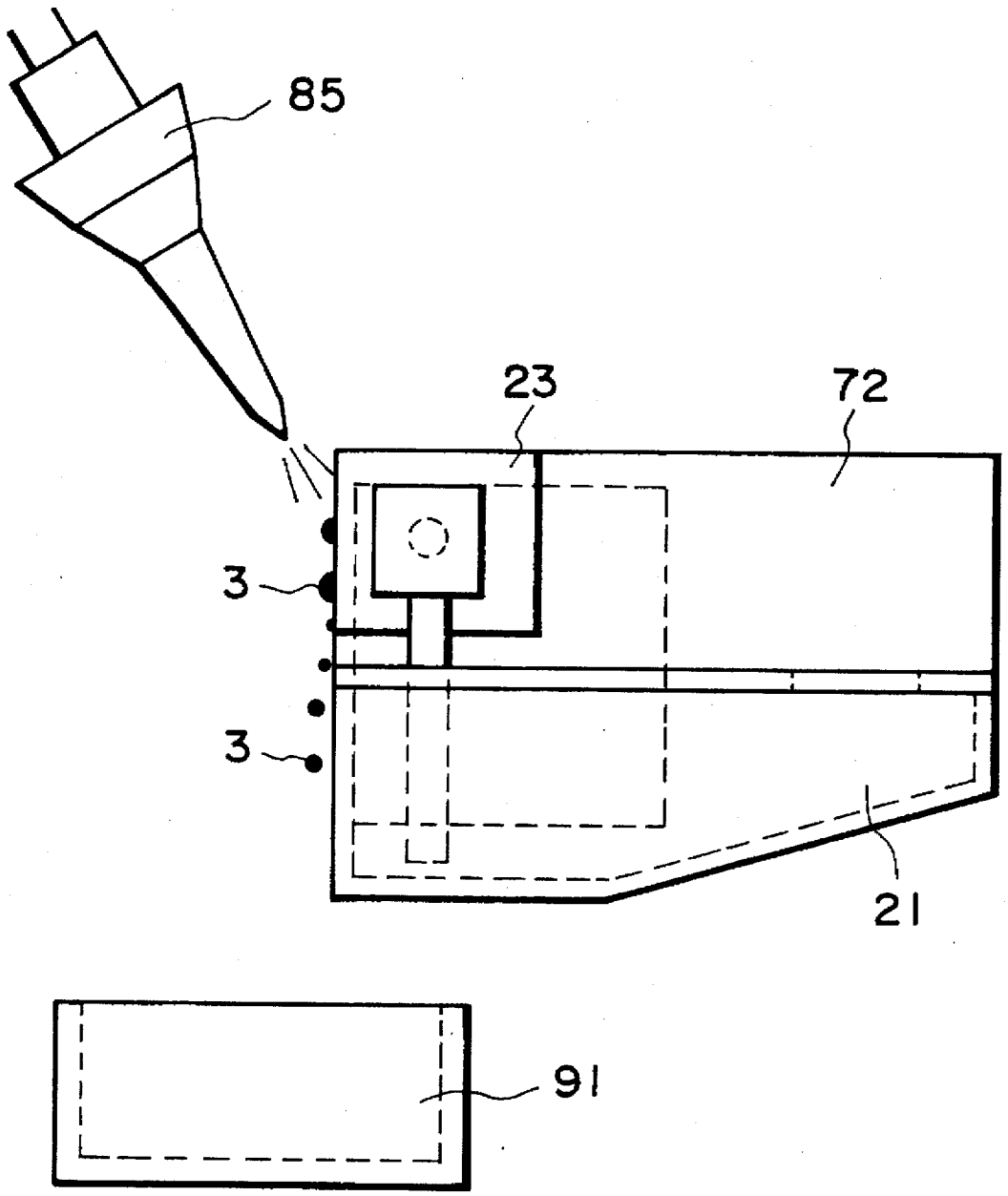
FIG. 13 is a side view for illustrating a relationship between an air nozzle and a recording head.

At the home position (i.e., position in the standby state) of the carriage 74, an ink suction box 84 is disposed opposite the orifice (ejection outlet) of the recording head 23. As shown in FIG. 12, the ink suction box 84 is movable reciprocally in the direction of double-headed arrow A so as to intimately attach to and leave from the orifice face of the recording head 23.

On a face opposite the recording head 23 of the ink suction box 84 is formed an opening 100 around which a seal rubber 86 is disposed. By the seal rubber 86, the contacting faces of the ink suction box 84 and the recording head 23 are completely sealed. The opening 100 communicates with an ink suction pump 89 through a suction tube 90. When the ink suction box 84 intimately contacts the recording head 23 and the ink suction pump 89 is driven, the recording material 3 in the nozzles of the recording head 23 is sucked into the ink suction box 84. As a result, the recording material 3 having an elevated viscosity is removed, whereby the discharge failure of the recording material 3 is prevented.

The recording material 3 sucked into the ink suction box 84 is discarded via a slit 95 and an ink exhaust pipe 88 into an ink disposed tank (not shown). Between the slit 95 and the ink exhaust pipe 88, a valve 93 is disposed without any energization, and is caused to close the slit 95 when the suction pump 89 is operated. When the suction pump 89 is not operated, the valve 93 releases the slit 95 and is held at a stopper 94.

An air nozzle 85, an air tube 86, an air pump 87 and an ink pan 91 may be disposed as desired. When an unnecessary portion of the recording material 3 is attached to an external surface of the recording head 23 and other parts, the attached portion of the recording material 3 is removed by blowing-off with an air stream supplied from the air pump 87, air tube 86 and air nozzle 85. The recording material blown off by the air stream is recovered in the ink pan 91.

Based on the above arrangement, when the power is turned on, the heating means 24 is first energized to hold the normally solid recording material in the tank 21 and the recording head 23 in a molten state.

The recording head 23 is held at its home position in the standby state, and the ink suction box 84 intimately contacts the recording head 23. When a recording signal is inputted to the recording head 23 in this state, the suction pump 89 is operated for a short time (e.g., 1 sec.) while the ink suction box 84 intimately contacts the recording head 23. By the operation of the suction pump 89, the valve 93 is closed and the recording material in the nozzle is sucked out to be discarded. If the normally solid recording material is held in the standby state for a long time, the viscosity thereof becomes high to be liable to result in discharge or ejection failure, whereas recording free of discharge failure may be effected by discarding the recording material within the nozzle prior to the recording.

After completing the suction, the ink suction box 84 is separated from the recording head 23, and the recording head 23 is shifted to the position facing the air nozzle 85, where an air stream is discharged from the air nozzle 85 to remove an unnecessary potion of the recording material attached to the recording head 23.

Thereafter, recording is performed on the recording medium 27. After completion of the recording, the recording head 23 is returned to the home position, where the ink suction box 84 is caused to intimately contact the recording head 23 to form a standby state again.

Figure 14:
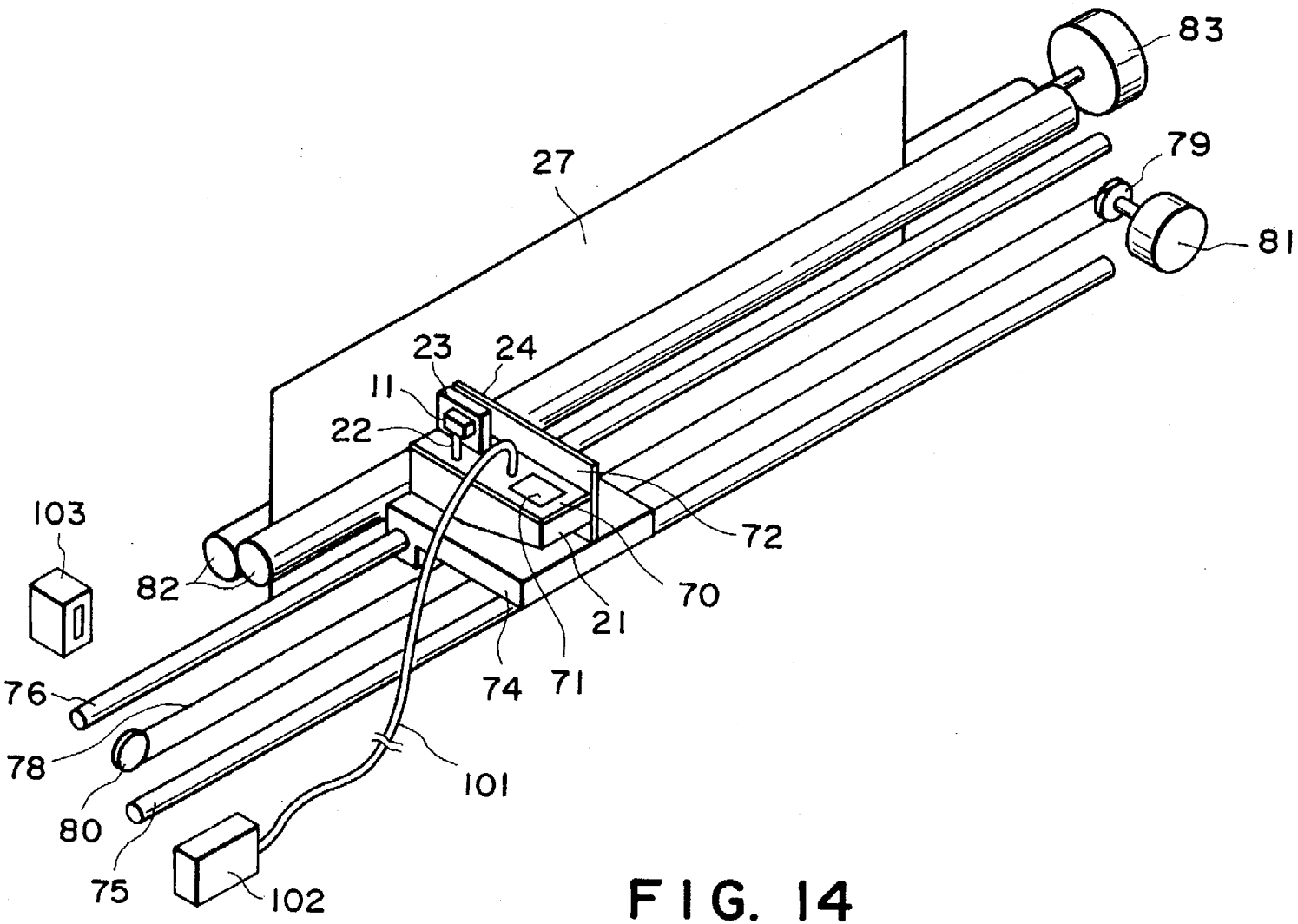
FIG. 14 is a perspective view showing another embodiment of a recording apparatus for use in the recording method according to the invention.
Figure 15:
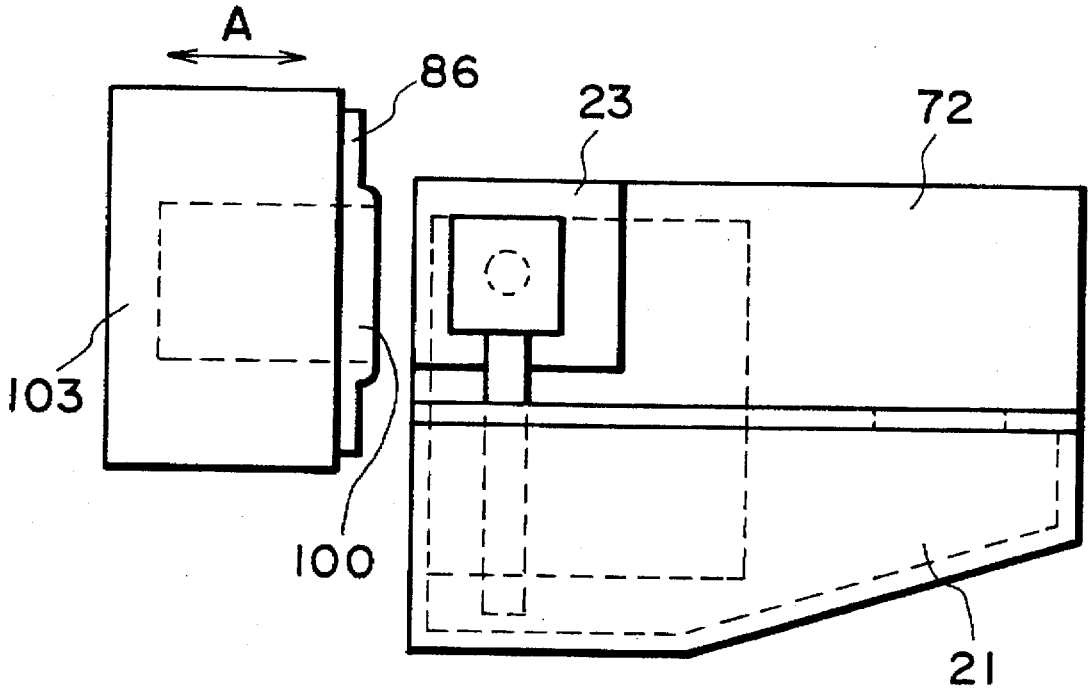
FIG. 15 is a side view for illustrating a relationship between a cap and a recording head.
Figure 16:
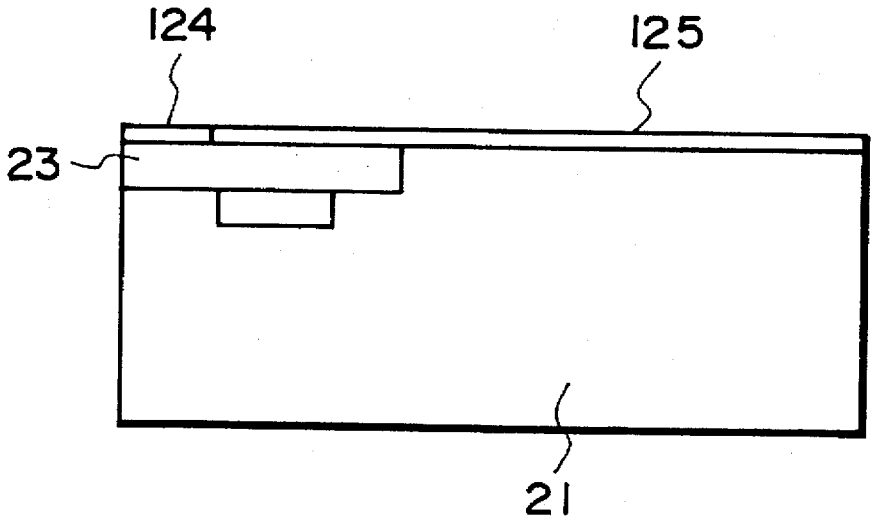
FIG. 16 is a plan view of a device unit including a recording head, a tank, a heating means and a heat-conducting member.
Figure 17:
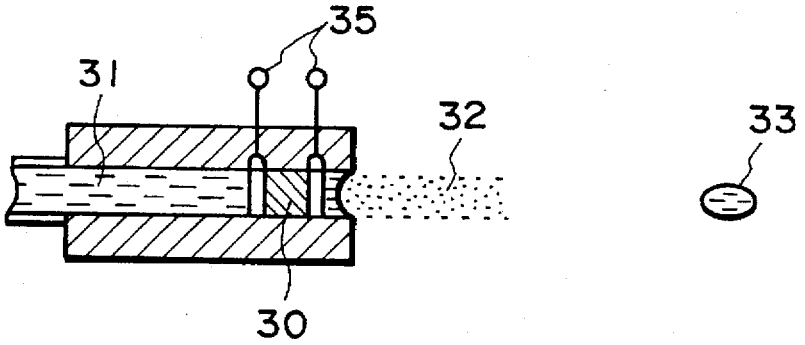
FIG. 17 is a sectional view for illustrating a known recording method.
Figure 18A:
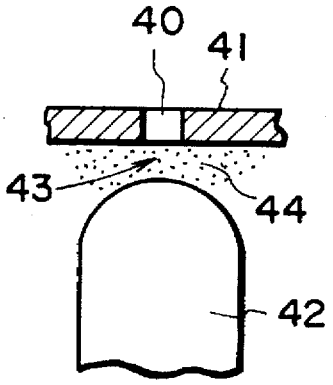
FIGS. 18A–18C are sectional views for illustrating another known recording method.
Figure 18B:
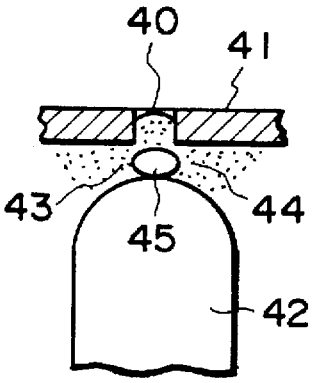
Figure 18C:
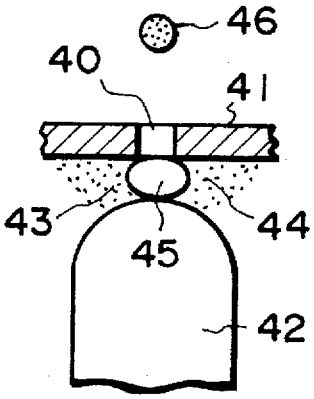
Figure 19A:
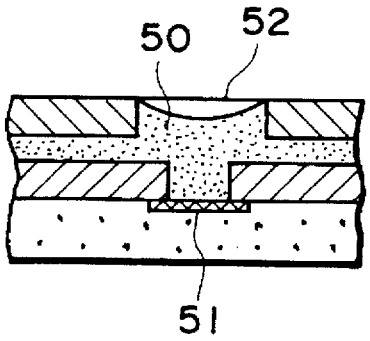
FIGS. 19A and 19B are sectional views for illustrating another known recording method.
Figure 19B:
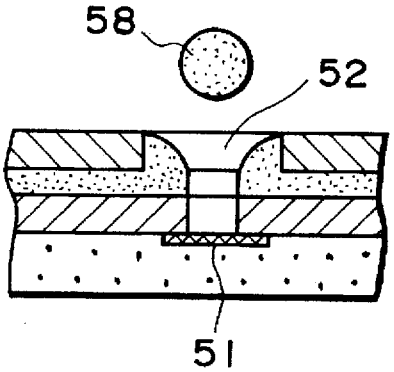
Figure 20:
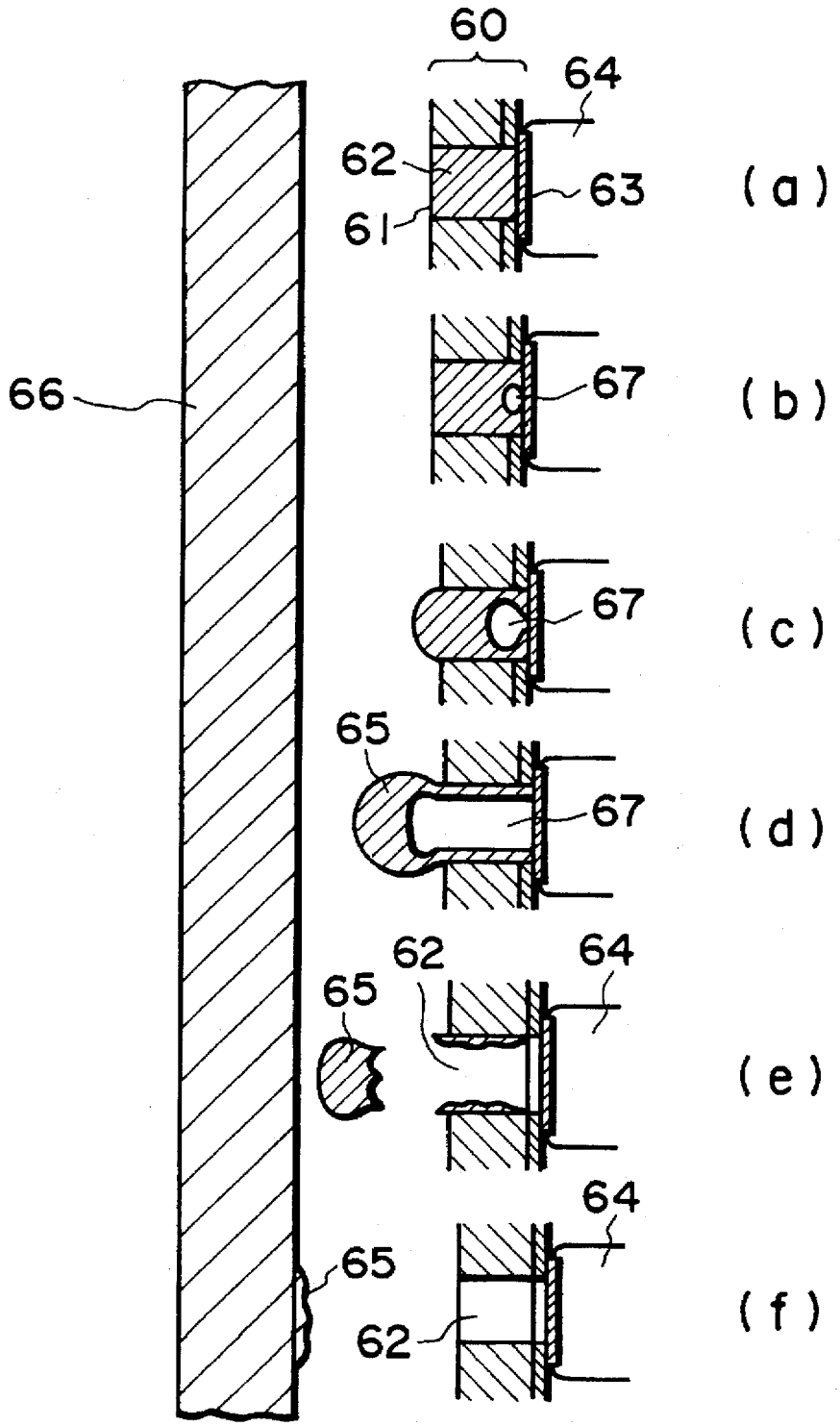
FIG. 20 shows a set of sectional views for illustrating still another known recording method.

In the above, an embodiment has been described, wherein the recording material in nozzles is sucked out by an ink suction box to be discarded. On the other hand, as shown in FIG. 14, it is possible to connect a pressurization pump 102 to the tank 21 via a tube 101 so as to pressurize the recording material in the tank 21 at the home position, thereby discharging the recording material within the nozzles for discard. In this case, it is suitable to dispose a cap 103 so as to intimately contact the recording head 23 at the home position, thereby preventing or minimizing the denaturation of the recording material within the nozzles. As illustrated in FIG. 15, the cap has a structure somewhat similar to that of the ink suction box 84 but is not provided with means for sucking or discarding the recording material.

The melting and heating by the heating means 24 may be controlled by a temperature sensor (not shown) so as to provide a temperature which is higher than the melting temperature of the normally solid recording material by 30° C.±5° C. In the case where the apparatus is held in a standby state while the power supply is on, the melting and heating by the heating means may suitably be controlled to provide a temperature which is lower by 20°–30° C. than the temperature at the time of recording. By keeping such a lower temperature in the standby state than the temperature for recording, it is possible to minimize the power consumption and also decrease the deterioration of the recording material under long term heating to the minimum.

Further, it is possible to dispose a heating means 124 only at the nozzle part of the recording head 23 and a thermally conductive member 125 adjacent to the heating means, so as to intimate the melting of the normally solid recording material from the nozzles and propagate the melting toward the liquid chamber 10 (FIG. 2A), the ink supply tube 22 (FIG. 10) and the tank 21, i.e., successively in the direction of leaving away from the nozzles. By this arrangement, it is possible to disperse a stress caused by a volumetric expansion accompanying the melting of the normally solid recording material toward wider regions, thus obviating rupture of the recording head 23, in case where a recording material showing such a volumetric expansion on melting is used.

To the contrary, when the recording is terminated and the apparatus is brought to the standby state, it is suitable to decrease the temperature of the heating means 124 at a lower speed so that the solidification proceeds from a part remote from the nozzles toward the nozzles, thereby obviating the formation of a void due to volumetric shrinkage in the recording material. When a recording material solidifies from a liquid state, some recording material can cause a volumetric shrinkage of 10–20%. Therefore, if the solidification is caused irregularly in such a recording material, a void is liable to be formed in the recording material. If such a void is formed in the recording material, the discharge of the recording material becomes unstable and is liable to cause discharge failure.

The recording material used in the jet recording method according to the present invention is normally solid, i.e., solid at room temperature (5° C.–35° C.).

The normally solid recording material used in the present invention may comprise at least a heat-fusible solid substance and a colorant, and optionally additives for adjusting ink properties and a normally liquid organic solvent, such as an alcohol.

The normally solid recording material may preferably have a melting point in the range of 36° C. to 200° C. Below 36° C., the recording material is liable to be melted or softened according to a change in room temperature to soil hands. Above 200° C., a large quantity of energy is required for liquefying the recording material. More preferably, the melting point is in the range of 36° C.–150° C.

The heat-fusible substance contained in the normally solid recording material may, for example, include: acetamide, p-vaniline, o-vaniline, dibenzyl, m-acetotoluidine, phenyl benzoate, 2,6-dimethylquinoline, 2,6-dimethoxyphenol, p-methylbenzyl alcohol, p-bromoacetophenone, homocatechol, 2,3-dimethoxybenzaldehyde, 2,4-dichloroaniline, dichloroxylylene, 3,4-dichloroaniline, 4-chloro-m-cresol, p-bromophenol, dimethyl oxalate, 1-naphthol, dibutylhydroxytoluene, 1,3,5-trichlorobenzene, p-tertpentylphenol, durene, dimethyl-p-phenylenediamine, tolan, styrene glycol, propionamide, diphenyl carbonate, 2-chloronaphthalene, acenaphthene, 2-bromonaphthalene, indole, 2-acetylpyrrole, dibenzofuran, p-chlorobenzyl alcohol, 2-methoxynaphthalene, tiglic acid, p-dibromobenzene, 9-heptadecanone, 1-tetradecanamine, 1,8-octanediamine, glutaric acid, 2,3-dimethylnaphthalene, imidazole, 2-methyl-8-hydroxyquinoline, 2-methylindole, 4-methylbiphenyl, 3,6-dimethyl-4-octyne-diol, 2,5-dimethyl-3-hexyne-2,5-diol, 2,5-dimethyl-2,5-hexanediol, ethylene carbonate, 1,8-octane diol, 1,1-diethylurea, butyl p-hydroxybenzoate, methyl 2-hydroxynaphthoate, 8-quinolinol, stearylamine acetate, 1,3-diphenyl-1,3-propanedione, methyl m-nitrobenzoate, dimethyl oxalate, phthalide, 2,2-diethyl-1,3propanediol, N-tert-butylethanolamine, glycolic acid, diacetylmonooxime, and acetoxime. These heat-fusible substances may be used singly or in mixture of two or more species.

The above-mentioned heat-fusible substances include those having various characteristics, such as substances having particularly excellent dischargeability, substances having particularly excellent storability and substances providing little blotting on a recording medium. Accordingly, these heat-fusible substances can be selected depending on desired characteristics.

A heat-fusible substance having a melting point Tm and a boiling point Tb (at 1 atm. herein) satisfying the following formulae (A) and (B) may preferably be used so as to provide a normally solid recording material which is excellent in fixability of recorded images and can effectively convert a supplied thermal energy to a discharge energy.

$$36° \text{ C.} \leqq Tm \leqq 150° \text{ C.} \quad (A)$$

$$150° \text{ C.} \leqq Tb \leqq 370° \text{ C.} \quad (B)$$

The boiling point Tb may preferably satisfy 200° C.≦Tb≦340° C.

The colorant contained in the normally solid recording material may include known ones inclusive of various dyes, such as direct dyes, acid dyes, basic dyes, disperse dyes, vat dyes, sulfur dyes and oil-soluble dyes, and pigments. A particularly preferred class of dyes may include oil-soluble dyes, including those described below disclosed in the color index:

C.I. Solvent Yellow 1, 2, 3, 4, 6, 7, 8, 10, 12, 13, 14, 16, 18, 19, 21, 25, 25:1, 28, 29, etc.;

C.I. Solvent Orange 1, 2, 3, 4, 4:1, 5, 6, 7, 11, 16, 17, 19, 20, 23, 25, 31, 32, 37, 37:1, etc.;

C.I. Solvent Red 1, 2, 3, 4, 7, 8, 13, 14, 17, 18, 19, 23, 24, 25, 26, 27, 29, 30, 33, 35, etc.;

C.I. Solvent Violet 2, 3, 8, 9, 10, 11, 13, 14, 21, 21:1, 24, 31, 32, 33, 34, 36, 37, 38, etc.;

C.I. Solvent Blue 2, 4, 5, 7, 10, 11, 12, 22, 25, 26, 35, 36, 37, 38, 43, 44, 45, 48, 49, etc.;

C.I. Solvent Green 1, 3, 4, 5, 7, 8, 9, 20, 26, 28, 29, 30, 32, 33, etc.;

C.I. Solvent Brown 1, 1:1, 2, 3, 4, 5, 6, 12, 19, 20, 22, 25, ,28, 29, 31, 37, 38, 42, 43, etc.; and C.I. Solvent Blank 3, 5, 6, 7, 8, 13, 22, 22:1, 23, 26, 27, 28, 29, 33, 34, 35, 39, 40, 41, etc.

It is also preferred to use inorganic pigments, such as calcium carbonate, barium sulfate, zinc oxide, lithopone, titanium oxide, chrome yellow, cadmium yellow, nickel titanium yellow, naples yellow, yellow iron oxide, red iron oxide, cadmium red, cadmium mercury sulfide, Prussian blue, and ultramarine; carbon black; and organic pigments, such as azo pigments, phthalocyanine pigments, triphenylmethane pigments and vat-type pigments.

The normally solid recording material can further contain a normally liquid organic solvent, as desired, examples of which may include alcohols, such as 1-hexanol, 1-heptanol, and 1-octanol; alkylene glycols, such as ethylene glycol, propylene glycol, and triethylene glycol; ketones, ketone alcohols, amides, and ethers. Such an organic solvent may have a function of enlarging the size of a bubble generated in the recording material and may preferably have a boiling point of at least 150° C.

The normally solid recording material can result in a relief image on a recording paper which is poor in rubbing resistance because of too large a solidifying speed depending on the heat-fusible substance used. In such a case of resulting in a relief image, it is suitable to retard the solidification of the recording material by incorporating a liquid having a low vapor pressure (of at most 3 mmHg at 25° C.) in the recording material. The lower limit of the vapor pressure of such a liquid may be on the order of 0.001 mmHg at 25° C.

Examples of such a low-vapor pressure liquid may include: γ-butylolactone, 2-pyrrolidone, propylene carbonate, N-methyl-2-pyrrolidone, N-methylpropionamide, N-methylacetamide, 2-butoxyethanol, dipropylene glycol monomethyl ether, dipropylene glycol monoethyl ether, tripropylene glycol monomethyl ether, diacetone alcohol, 2-ethoxyethyl acetate, butoxyethyl acetate, diethylene glycol monoethyl ether acetate, and diethylene glycol monobutyl ether acetate.

The normally solid recording material can further contain optional additives, such as antioxidants, dispersing agents and anti-corrosion agents.

The normally solid recording material may preferably contain 50–99 wt. %, particularly 60–95 wt. %, of a heat-fusible substance; 1–20 wt. %, particularly 3–15 wt. %, of a colorant; and 0–10 wt. % of an optionally added organic solvent.

The optional low-vapor pressure liquid, when contained, may preferably constitute 30–70 wt. %, particularly 35–60 wt. %, of the recording material.

Hereinbelow, the present invention is described more specifically with reference to Examples and Comparative Example.

EXAMPLE 1

| | |
|---|---|
| C.I. Solvent Black 3 | 5.0 wt. parts |
| Ethylene carbonate (Tm (melting point) = 39° C.) | 42.5 wt. parts |
| 1,12-Dodecane diol (Tm = 82° C.) | 42.5 wt. parts |

The above ingredients were stirred at 100° C. in a vessel to be uniformly mixed in solution, and the mixture in solution was filtered through a Teflon-made filter having a pore-diameter of 0.45 μm to be solidified, thus providing a normally solid ink, which was then used for recording in an apparatus as shown in FIG. 10 having a recording head as shown in FIG. 2.

The recording head-was composed to have 64 nozzles 15 at a rate of 400 nozzles/inch. Each nozzle had a height H of 27 μm and a width W of 40 μm and was provided with a heater 2 measuring 32 μm in width and 40 μm in length and disposed with a spacing of 20 μm from the orifice (ejection outlet) 5 to its front end.

Then, the ink was held in a standby state for 30 min. while the electric power supply was continually on and thereafter sucked for 1 second by an ink suction box 84, followed by removal of an unnecessary portion of the ink attached to the recording head. Then, the recording was performed. As a result, the recording was effected with a stable discharge and without discharge failure. During the recording, each heater 2 in the recording head was supplied with a voltage pulse of 16.0 volts in amplitude and 2.5 μsec in width at a frequency of 1 kHz.

Separately from the above, a normally solid ink identical to the one used in the above recording test except for omission of C.I. Solvent Black 3 was used in a similar recording test in an apparatus shown in FIG. 21, which was constituted to allow observation of a bubble formation in nozzles. The colorant was omitted so as to allow easier observation of a bubble.

Figure 21:
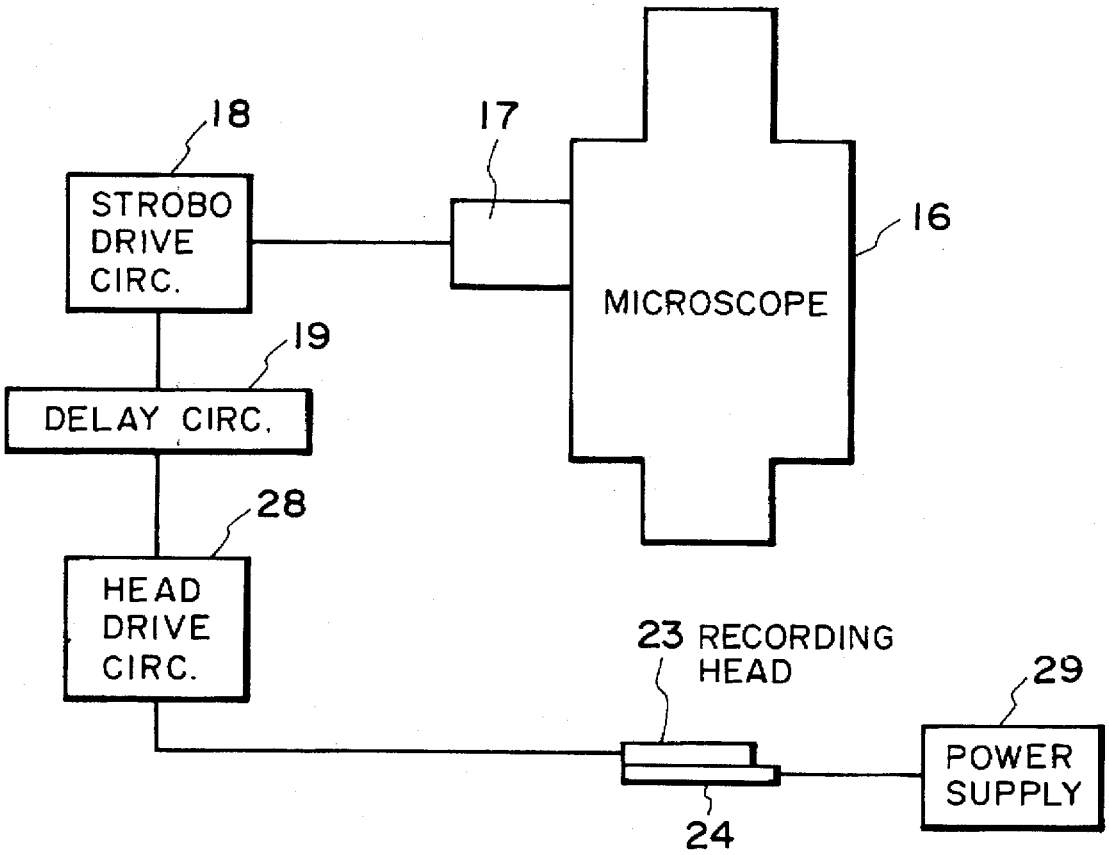
FIG. 21 is a schematic illustration of an embodiment of a recording apparatus designed so that a bubble-forming state and an elected state of a recording material can be observed.

The recording head 23 used in the apparatus of FIG. 21 was the same as the one used in the above recording test using the apparatus shown in FIG. 10 but was modified to allow observation of the inside by using a transparent ceiling plate 4 (FIG. 2A). Above the recording head 23 was disposed a microscope 16 so as to be able to observe the inside of the nozzles 15 through the transparent ceiling plate. A strobo 17 was attached to the microscope 16 so as to allow the observation of the bubble forming and discharge of the ink only when the strobo 17 flashed. The strobo 17 was disposed so that it flashed after lapse of an arbitrarily settable delay time from the commencement of heat application from the heater 2 by means of a strobo drive circuit 18 and a delay circuit 19. The recording head 23 was equipped with a heating means 24 connected to an external power supply 29 so as to heat the recording head 23 at 100° C. to keep the ink in a molten state. The head 23 was driven by a head drive circuit 28. Thus, the ink in a molten state filling the ink tank 21 in the recording head 23 and supplied to the nozzles 15 was heated by the heaters 2 energized with a pulse current, so that bubbles generated on the heaters 2 were observed at varying delay time for strobo flashing. As a result, it was observed that each bubble was allowed to communicate with the ambience about 3 μsec after the initiation of the bubble formation and the ink was stably discharged.

EXAMPLE 2

The same ink as used in Example 1 was used for recording by using an apparatus as shown in FIG. 14. The recording head and the current supply conditions thereto were similar to those used in Example 1.

Thus, the ink was held in a standby state for 30 min. while the electric power supply was continually on. Then, the ink was pressurized for 1 sec. by a pump 102 and thereafter used for recording. As a result, the recording was performed with stable discharge and without discharge failure.

Comparative Example

Recording was performed in the same manner as in Example 1 except that no suction was effected by using the ink suction box 84 after the ink was held in a standby state for 30 min. while the electric power supply was continually on. As a result, discharge failure was caused at 30 nozzles among the 64 nozzles.

As described above, according to the present invention, it is possible to remove a recording material having an increased viscosity formed in nozzles when an apparatus is stopped for a long term. Accordingly, it is possible to provide a reliable recording method free from discharge failure or unstable discharge.

What is claimed is:

1. A jet recording method, comprising:

a preliminary step of placing a normally solid recording material in a heat-melted state in a path defined by a nozzle leading to an ejection outlet and in a tank communicatively connected with the nozzle, and a recording step of imparting a thermal energy corresponding to a recording signal to the melted recording material to generate a bubble, thereby ejecting a droplet of the recording material out of the ejection outlet by an action of the bubble;

wherein, prior to the recording step, the recording material is ejected out of the election outlet by sucking the recording material in the nozzle or pressurizing the recording material in the tank while the election outlet does not face the recording medium and, in the recording step, the bubble is communicated with ambience.

2. A method according to claim 1, wherein the bubble communicates with the ambience having an ambient pressure when the bubble has an internal pressure not higher than said ambient pressure.

3. A method according to claim 1, wherein a portion of the recording material ejected out of the ejection outlet by the suction or pressurization is blown off by an air stream.

4. A method according to claim 1, wherein said ejection outlet formed within a recording head is covered with a cap when it is in a standby state prior to the recording step.

5. A method according to claim 1, wherein said recording material is held in a heat-melted state at a temperature which is lower than that in the recording step.

6. A method according to claim 1, wherein said recording material is placed in a heat-melted state by causing and propagating the heat-melting of the recording material from the ejection outlet in a direction of leaving away from the ejection outlet.

7. A method according to claim 1, wherein, after the recording step, said recording material is solidified in a path which starts at a point remote from the ejection outlet and continues in a direction toward the ejection outlet.

* * * * *

UNITED STATES PATENT AND TRADEMARK OFFICE

CERTIFICATE OF CORRECTION

PATENT NO. : 5,680,165

DATED : October 21, 1997

INVENTOR(S) : YOSHIHISA TAKIZAWA, ET AL.

It is certified that error appears in the above-identified patent and that said Letters Patent is hereby corrected as shown below:

In the title page, item:

[56] References Cited:

"Merrit et al." should read --Merritt et al.--.

In the disclosure:

Column 1:

Line 14, delete ",4,723,129".

Column 3:

Line 33, "View" should read --view--.

Column 4:

Line 10, "With" should read --with--.

UNITED STATES PATENT AND TRADEMARK OFFICE

CERTIFICATE OF CORRECTION

PATENT NO. : 5,680,165 Page 2 of 3

DATED : October 21, 1997

INVENTOR(S) : YOSHIHISA TAKIZAWA, ET AL.

It is certified that error appears in the above-identified patent and that said Letters Patent is hereby corrected as shown below:

Column 6:

Line 24, ".ambience" should read --ambience--.

Column 7:

Line 36, "as" should read --is--.

Column 10:

Line 2, "potion" should read --portion--.

Column 12:

Line 11, "Blank" should read --Black--.

Column 14:

Line 36, "election" should read --ejection--;
Line 38, "election" should read --ejection--;

UNITED STATES PATENT AND TRADEMARK OFFICE

CERTIFICATE OF CORRECTION

PATENT NO. : 5,680,165

DATED : October 21, 1997

INVENTOR(S) : YOSHIHISA TAKIZAWA, ET AL.

It is certified that error appears in the above-identified patent and that said Letters Patent is hereby corrected as shown below:

Column 14:

Line 57, "of leaving" should be deleted.

Signed and Sealed this

Twenty-sixth Day of May, 1998

*Attest:*

Bruce Lehman

BRUCE LEHMAN

*Attesting Officer*

*Commissioner of Patents and Trademarks*